US005983680A

United States Patent [19]

Del Nin

[11] Patent Number: 5,983,680

[45] Date of Patent: Nov. 16, 1999

[54] DOOR LOCKING DEVICE

[75] Inventor: Lou F. Del Nin, Scarborough, Canada

[73] Assignee: Michael Wells, Pickering, Canada

[21] Appl. No.: 08/967,778

[22] Filed: Nov. 10, 1997

[51] Int. Cl.[6] ..... E05B 65/00; E05C 17/06

[52] U.S. Cl. ..... 70/93; 16/82; 70/131; 292/272; 292/DIG. 15

[58] Field of Search ..... 70/93, 131, 143; 292/DIG. 15, 272, 273; 16/82

[56] References Cited

U.S. PATENT DOCUMENTS

| | | | |
|---|---|---|---|
| 449,677 | 4/1891 | Higbee | 70/120 |
| 660,403 | 10/1900 | Sutton | 292/39 |
| 663,503 | 12/1900 | Laureyns | 70/93 |
| 889,453 | 6/1908 | Gerson | 292/60 |
| 966,208 | 8/1910 | Hoes | 70/109 |
| 1,107,124 | 8/1914 | Spain . | |
| 1,111,485 | 9/1914 | Melander | 292/272 |
| 1,190,439 | 7/1916 | Marchfeld | 70/120 |
| 1,203,965 | 11/1916 | Bogenberger . | |
| 1,452,014 | 4/1923 | Wolfe et al. . | |
| 1,548,744 | 8/1925 | Pratt | 292/269 |
| 1,723,064 | 8/1929 | Nelson | 70/93 |
| 1,871,142 | 8/1932 | Bianchi et al. . | |
| 2,329,017 | 9/1943 | Voight | 70/93 |
| 2,368,411 | 1/1945 | Chambers et al. | 70/93 |
| 2,369,136 | 2/1945 | Chambers et al. | 70/93 |
| 2,743,126 | 4/1956 | Carsley et al. | 292/39 |
| 2,787,154 | 4/1957 | Wesberry | 292/39 X |
| 3,111,340 | 11/1963 | Spencer | 292/229 |
| 3,986,741 | 10/1976 | Giovannini | 70/93 X |
| 3,991,595 | 11/1976 | Bahry et al. | 70/120 |
| 4,037,440 | 7/1977 | Shabtai et al. | 70/108 |
| 4,154,070 | 5/1979 | Bahry et al. | 70/108 |
| 4,213,315 | 7/1980 | Lewis | 70/94 |
| 4,362,034 | 12/1982 | Amgar | 70/108 |
| 4,456,291 | 6/1984 | Brogie | 292/DIG. 15 X |
| 4,601,502 | 7/1986 | Van Dyke | 292/252 |
| 4,984,832 | 1/1991 | Canepa | 292/36 |
| 5,490,304 | 2/1996 | Winner, Jr. et al. | 16/82 |
| 5,590,918 | 1/1997 | Kambalov | 292/60 |

FOREIGN PATENT DOCUMENTS

| | | | |
|---|---|---|---|
| 0141785 | 5/1985 | European Pat. Off. . | |
| 2155159 | 5/1973 | France . | |
| 4012257 | 10/1911 | Germany | 292/DIG. 15 |
| 2522222 | 12/1976 | Germany . | |
| 2841 | 2/1913 | United Kingdom | 292/273 |
| 2101192 | 1/1983 | United Kingdom . | |
| 2199610 | 7/1988 | United Kingdom . | |
| 2200165 | 7/1988 | United Kingdom . | |

*Primary Examiner*—Lloyd A. Gall
*Attorney, Agent, or Firm*—Riches, McKenzie & Herbert

[57] ABSTRACT

A security lock is described which permits a door to be opened by a predetermined amount while maintaining security against forced entry. Preferably, the security lock also functions as a deadbolt lock and comprises a slotted floor plate covering an aperture in the floor, a vertical bolt extendable into the aperture, and a lock mechanism which raises and lowers the bolt into and out of engagement with the floor plate. In a first engaged position, the end of the bolt is locked into engagement with the floor plate in such a manner that the door may be partially open. However, the bolt cannot be removed from the floor plate with the door open, thus providing security against forced entry through the partially open door. In a second engaged position, with the door completely closed, the bolt may be raised or lowered into or out of engagement with the floor plate, similar to a conventional deadbolt lock. The security lock therefore provides improved security and convenience over known devices such as door chains and security doorstops.

8 Claims, 10 Drawing Sheets

12
14
10
18
8
34
8'
52
7'
20
7
48
36
46
50
38

12
14
18
10
10'
20
A
34
10
52
48
38
50
46

DOOR LOCKING DEVICE

FIELD OF THE INVENTION

This invention relates to door locking devices, and particularly to locking devices which permit a door to be opened by a predetermined amount while maintaining security against forced entry.

BACKGROUND OF THE INVENTION

Numerous devices are known to prevent forced entry through a partially open door. One common device of this type is the door chain. One end of the door chain is typically attached to a plate which is fastened by screws or the like to the door jamb or casing. The other end of the chain is releasably connected to a bracket or the like mounted on the inside face of the door, from which the end of the chain may be disconnected only when the door is completely closed. The length of the chain is such that the door may be partially opened with the chain fastened to the door.

However, door chains typically provide poor protection against forced entry. Forces exerted on the outside of the door have been known to break the chain itself or break the chain free from its supports. Even if the door chain is strong enough to withstand such forces, it may be sawn through or cut with a metal cutter or the like.

Other devices have been developed which are superior to door chains in terms of protection against forced entry. Typical devices of this type are shown in U.S. Pat. No. 5,490,304 issued Feb. 13, 1996 to Winner, Jr. et al., and U.S. Pat. No. 5,590,918 issued on Jan. 7, 1997 to Kambalov. Both of these patents relate to floor mounted doorstops which secure a completely closed door and also allow the door to be opened a small amount while keeping it secured against forced entry.

The floor mounted doorstop described by Winner, Jr. et al. comprises a vertical post inserted into a sleeve embedded in a joist below the floor. The top of the vertical post is provided with a horizontal sleeve through which extends a pivoting member. When the pivoting member is pivoted into engagement against the closed door, it provides protection against forced opening of the door while the door is closed. When the pivoting member is pivoted away from the door, the door may be opened by a small amount until it contacts the vertical post of the door stop.

Kambalov describes a similar device having a vertical post extending below the floor. A horizontal cam having a plurality of surfaces is eccentrically connected to the top of the vertical post. The cam may be rotated into engagement with the door, in which position it provides protection against forced entry when the door is completely closed. When the cam is rotated out of engagement with the door, the door may be opened by a small amount.

While the devices provided by Kambalov and Winner, Jr. et al. provide protection against forced entry both when the door is closed and when the door is partially open, they have several disadvantages. Firstly, the Kambalov and Winner, Jr. et al. devices may only be operated from inside the door. Therefore, these devices are only useful when the occupants of the house or apartment in which they are installed are at home. Secondly, in order to completely open the door, the Kambalov and Winner, Jr. et al. devices must be completely removed from the floor and be set aside where they will not interfere with the swinging door.

Therefore, the disadvantage exists that known devices for preventing forced entry through a partially open door are inconvenient to use and/or provide insufficient protection against break-ins.

A further disadvantage exists in that devices which prevent forced entry through either a closed or partially open door do not provide protection against forced entry while the occupants are out.

SUMMARY OF THE INVENTION

The present invention addresses the disadvantages of the prior art in a novel manner by providing a strong, easy to use security lock which protects a door from forced entry while it is partially open.

The security lock of the present invention comprises an elongate bolt secured to a door and which is slidable in a direction parallel to one of its faces. The elongate bolt is extendable into at least one engaged position in which an end portion of the bolt extends into an aperture adjacent to the door, similar to a conventional deadbolt. Also like a conventional deadbolt, complete removal of the bolt from the aperture allows the door to be opened completely.

However, unlike a conventional deadbolt, the door may be opened by a predetermined amount with the bolt in an engaged position in the aperture. This is accomplished by providing the aperture in the form of an elongate slot, such that when the door is pivoted in the opening, the bolt is movable in a lengthwise dimension of the aperture.

The security lock of the present invention is further provided with a locking mechanism which prevents withdrawal of the bolt from the aperture while the door is in an open position, and a release mechanism which permits withdrawal of the bolt from the aperture only when the door is closed.

Therefore, in the security lock of the present invention, the bolt preferably remains mounted to the door, regardless of whether it is engaged or disengaged. This overcomes the disadvantage of floor-mounted devices such as Kambalov and Winner, Jr. et al. that the locking device must be manually removed from the floor and set aside in order to completely open the door.

Also, the bolt can only be removed from, or inserted into, the aperture when the door is completely closed. This prevents potential intruders from removing the bolt from the aperture while the door is partially open.

In a preferred aspect of the present invention, the locking mechanism comprises three elements. Firstly, a plate having an elongate opening is provided over the aperture, the elongate opening of the plate having a width less than the width of the aperture. Secondly, the end of the bolt which extends into the aperture has a diameter greater than the width of the elongate opening in the plate, such that when the bolt is engaged in the aperture it cannot be removed from the aperture through the plate. Thirdly, the bolt has an intermediate portion, adjacent the end portion, having a diameter less than the width of the elongate opening in the plate. At least a portion of this intermediate portion of the bolt is in registry with the elongate opening of the plate when the bolt is engaged. This allows movement of the bolt along the elongate opening of the plate when the bolt is engaged in the aperture.

In another preferred aspect of the present invention, the releasing mechanism comprises an enlarged opening in the plate which communicates with the elongate opening of the plate. The enlarged opening has a width greater than the width of the elongate opening and also greater than the diameter of the end portion of the bolt. This permits the bolt to be withdrawn from, and inserted into, the aperture through the enlarged opening.

The enlarged opening is preferably positioned relative to the elongate opening of the plate such that withdrawal and insertion of the bolt is permitted only when the door is closed.

In yet another preferred aspect, a first portion of the aperture, into which the bolt is extendable through the elongate opening in the plate, has a first depth, and a second portion of the aperture, into which the bolt is extendable through the enlarged opening in the plate, has a second depth, the second depth being greater than the first depth. In this aspect of the invention, the bolt is capable of adopting at least two engaged positions. In a first engaged position, the bolt extends into the aperture to a depth less than or equal to the first depth of the aperture. In a second engaged position, the bolt extends into the second, deeper portion of the aperture to a depth greater than the first depth of the aperture.

In the first engaged position, the door may be opened by a predetermined amount with the bolt moving along the length of the aperture. However, in the second engaged position, the bolt is confined to the second, deeper portion of the aperture. Preferably, when the bolt is in the second engaged position, the door is closed. Therefore, the enlarged opening of the plate preferably communicates with the end of the elongate opening of the plate which is closest to the door opening.

Therefore, in this preferred aspect, the present invention provides a security lock which prevents forced entry both when the door is completely closed with the bolt in the second engaged position, and with the door partially open with the bolt in the first engaged position.

Preferably, the security lock of the present invention is mounted to a door having a first vertical edge connected by hinges to an edge of the door opening. The bolt preferably extends along the inner face of the door and is secured to the inner face by at least one bracket permitting longitudinal sliding motion of the bolt.

It is preferred that the bolt is oriented vertically, with the elongate aperture preferably being formed in the floor proximate a second vertical edge of the door which is opposite to the hinged edge.

In yet another preferred aspect, the bolt is extended into or withdrawn from the aperture by a locking mechanism which also controls a second, conventional deadbolt. This permits the security lock of the present invention to be operated in conjunction with a conventional deadbolt lock from either side of the door, thus providing protection regardless of whether the occupants are at home or out. Preferably, this locking mechanism is gear driven.

In yet another preferred aspect of the present invention, a second locking mechanism is provided to raise and lower the bolt between its first and second engaged positions. This second locking mechanism allows the user to raise the bolt from its second engaged position in which the door is locked to its first engaged position in which the door may be partially opened. This second locking mechanism may preferably either be hand operated from the inside of the door only, or key operated from both faces of the door.

In yet another preferred aspect of the present invention, the first locking mechanism is connected to an upper end of the bolt by a gear driven mechanism.

Accordingly, it is one object of the present invention to provide a security lock which prevents forced entry through a partially open door.

It is another object of the present invention to provide a security lock which prevents forced entry through a door which is either closed or partially open.

It is yet another object of the present invention to provide a security lock which can be completely disengaged only when the door to which it is mounted is closed.

Further aspects and advantages of the invention will become apparent upon review of the following detailed description of the preferred embodiment of the invention.

BRIEF DESCRIPTION OF THE DRAWINGS

In order that the invention may be readily understood, preferred embodiments of the invention will be described by way of example with reference to the accompanying drawings in which:

FIG. 1 is a cut-away, isolated view of a second preferred locking mechanism according to the present invention.

DETAILED DESCRIPTION OF THE PREFERRED EMBODIMENTS

Figure 1:
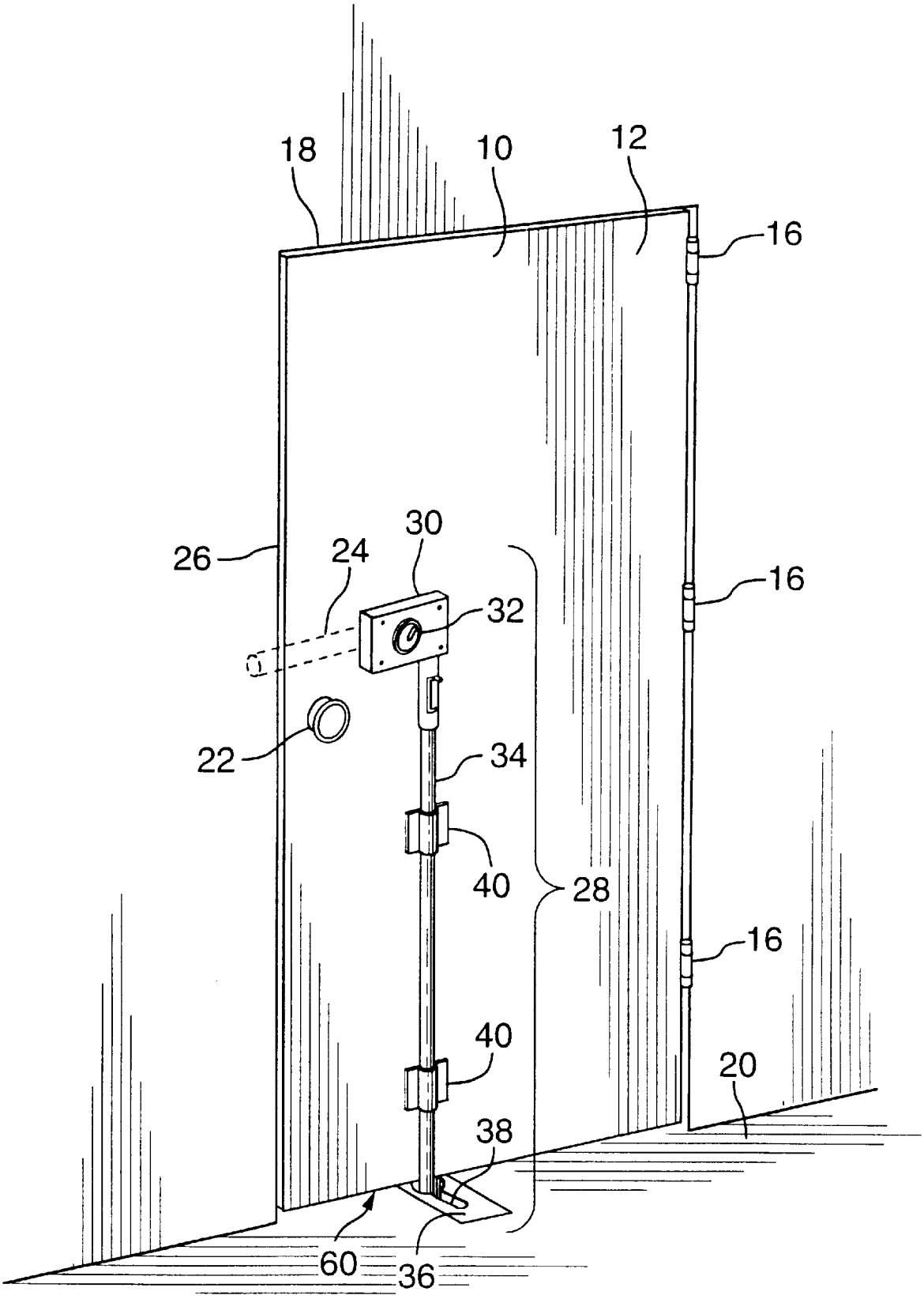
FIG. 1 is a perspective view of a preferred security lock of the present invention installed on a door.

FIG. 1 illustrates a door 10 having an inner face 12 and an outer face 14 (not shown) and being pivotably mounted on hinges 16 in a door opening 18 above a floor 20. Although door 10 is shown in FIG. 1 as being in a closed position, it is to be appreciated that door 10 is pivotable in door opening 18 in a conventional manner to adopt both open and closed positions.

Door 10 is equipped with a doorknob 22 which operates a conventional lock set (not shown), as well as a conventional horizontal deadbolt 24 extending through the inside of door 10 and into an aperture (not shown) in a vertical edge 26 of the door opening 18.

Also shown in FIG. 1 is a preferred security lock 28 according to the present invention. Security lock 28 comprises a lock mechanism 30 attached to the inner face 12 of door 10, a vertical bolt 34 extending vertically downwardly from lock mechanism 30, and a plate 36 attached to floor 20 and covering an aperture 38 in floor 20 into which vertical bolt 34 extends.

The bolt 34 is preferably made from a metal such as brass or steel, with a diameter of from about ⅜ to about ¾ inches, more preferably about ½ inch. Bolt 34 has a preferred length of from about 30 to about 48 inches when used on a conventional sized door, and is typically from about 40 to about 42 inches long.

The vertical bolt 34 is secured to door 10 by at least one saddle bracket 40, and preferably two or more saddle brackets 40 as shown in FIG. 1. The brackets 40 are secured to the inner face 12 of door 10 and permit vertical sliding motion of bolt 34 parallel to inner face 12 of door 10.

Figure 2:
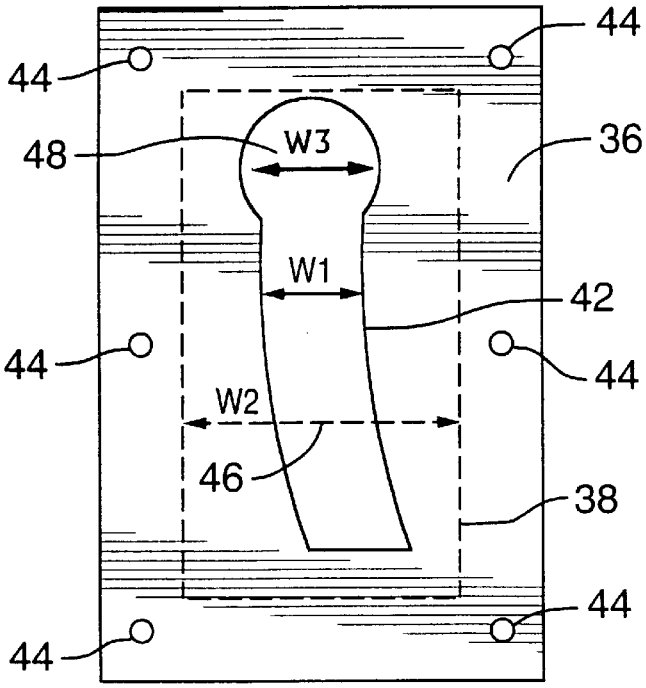
FIG. 2 is a top plan view of the floor plate of the security lock shown in FIG. 1.

FIG. 2 is a top plan view of a preferred floor plate 36 according to the invention having a central opening 42 and a plurality of peripheral holes 44 to receive fasteners by which the floor plate 36 is fastened to the floor 20. The periphery of the aperture 38 beneath the floor plate 36 is indicated in FIG. 2 by dotted lines.

The central opening 42 in floor plate 36 comprises two portions, an elongate slot portion 46 and an enlarged circular portion 48 at one end of the elongate slot 46, with the slot portion 46 and the circular portion 48 being in communication with one another. The width W1 of the elongate slot portion 46 of opening 42 is less than the width W2 of the aperture 38, and is preferably about ⅜ inch.

Figure 3:
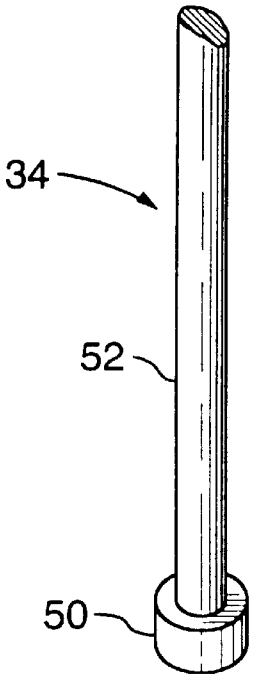
FIG. 3 is a perspective view of the bottom portion of the bolt of the security lock shown in FIG. 1.
Figure 4:
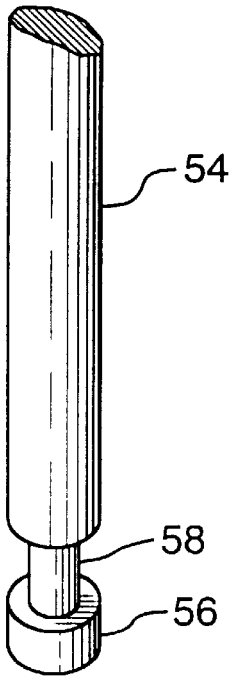
FIG. 4 is a perspective view of the bottom portion of a bolt according to another preferred embodiment of the invention.
Figure 5:
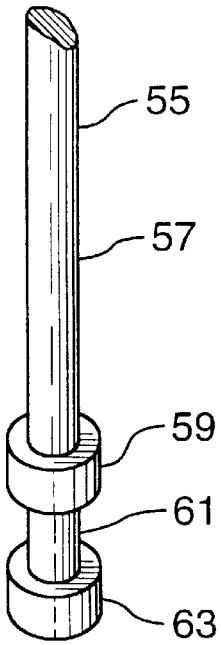
FIG. 5 is a perspective view of the bottom portion of a bolt according to yet another preferred embodiment of the invention.
Figure 6:
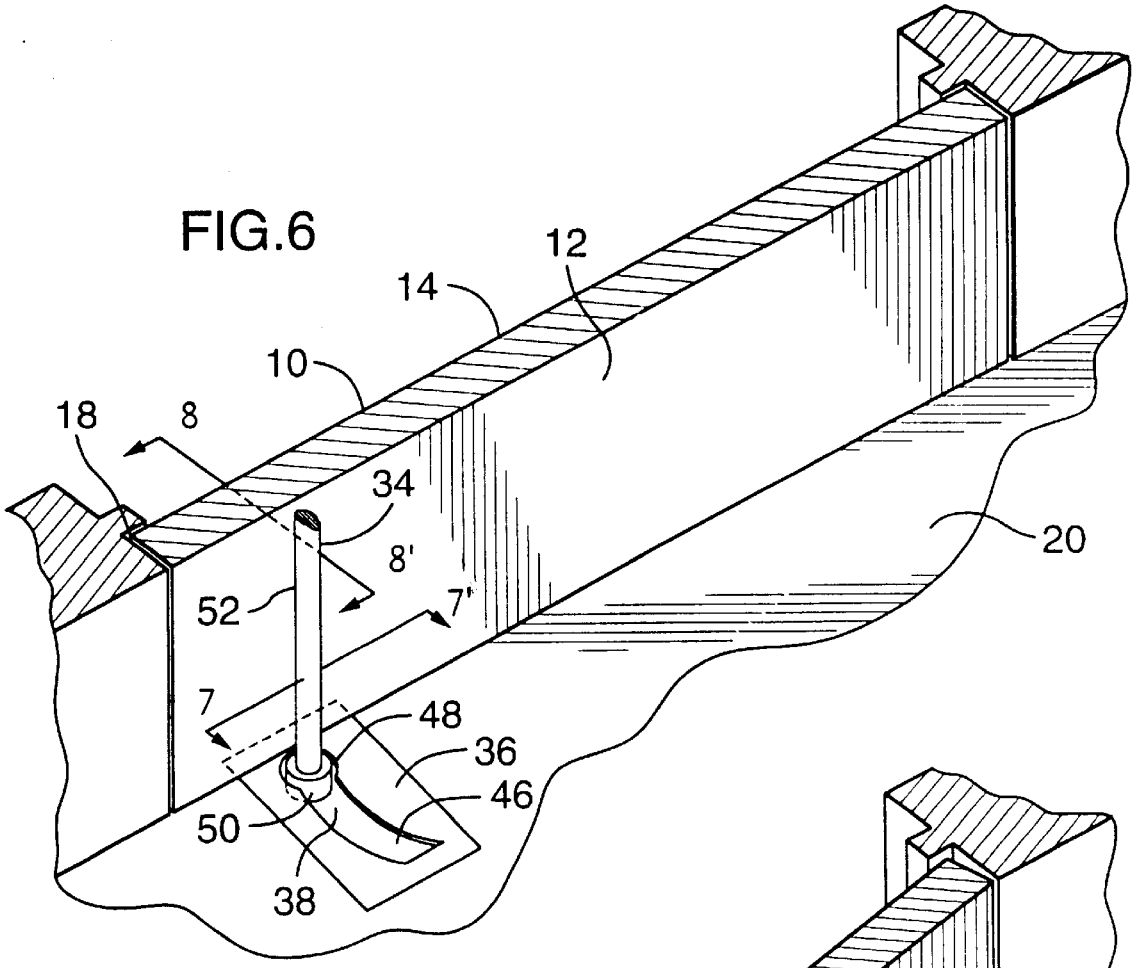
FIG. 6 is a cut-away perspective view showing the bottom portion of the door and the security lock of FIG. 1, with the door in a closed position.

Preferred bolts of the present invention have an end portion with a diameter greater than the width W1 of the elongate slot 46 and less than the width W2 of aperture 38. Preferably, the bolts of the invention also have an intermediate portion adjacent the end portion having a diameter less than the width W1 of elongate slot 46. The bottom portions of three preferred bolts according to the invention are shown in FIGS. 3 to 5. The most preferred bolt 34 is shown in FIG. 3, and has a short end portion 50, having a length of up to about ½ inch and a diameter greater than W1, preferably about ½ inch. Adjacent to end portion 50 is a long intermediate portion 52 having a diameter less than W1, preferably about ⅜ inch. The remainder of bolt 34 is of the same diameter as intermediate portion 52.

Another preferred bolt 54 is shown in FIG. 4 having an end portion 56 and an intermediate portion 58. The remainder of bolt 54 above intermediate portion 58 has the same diameter as the enlarged end portion 56. Yet another preferred bolt 55 is shown in FIG. 5 comprising a rod 57, the end of which is provided with enlarged portions 59 and 63 separated by an intermediate portion 61 having the same diameter as the upper portion of rod 57. Bolt 55 shown in FIG. 5 may provide improved protection against forced entry in the event that the security lock is tampered with and bolt 55 becomes detached from the door. Specifically, enlarged portions 59 and 63 ensure that bolt 55 remains upright and thereby prevents the door from being opened. Similarly, bolt 54 would also remain upright if detached from door 10. Although the preferred security lock 28 described herein uses bolt 34, it is to be appreciated that bolts 54 and 55 may provide equally preferred results.

Bolt 34 is capable of being vertically raised and lowered relative to the door 10. FIGS. 6 to 10 show bolt 34 in a first engaged position in which the enlarged end portion 50 of bolt 34 extends downwardly of the bottom edge 60 of door 10, through the central opening 42 in floor plate 36, and into aperture 38. In this first engaged position, security lock 28 functions as a security door stop to prevent forced entry through a partially open door 10.

As best seen in the cross-sectional views of FIGS. 7 and 8, the end portion 50 of bolt 34 is received in aperture 38 below floor plate 36, with a portion 64 of intermediate portion 52 of bolt 34 being in registry with central opening 42 of floor plate 36.

Figure 8:
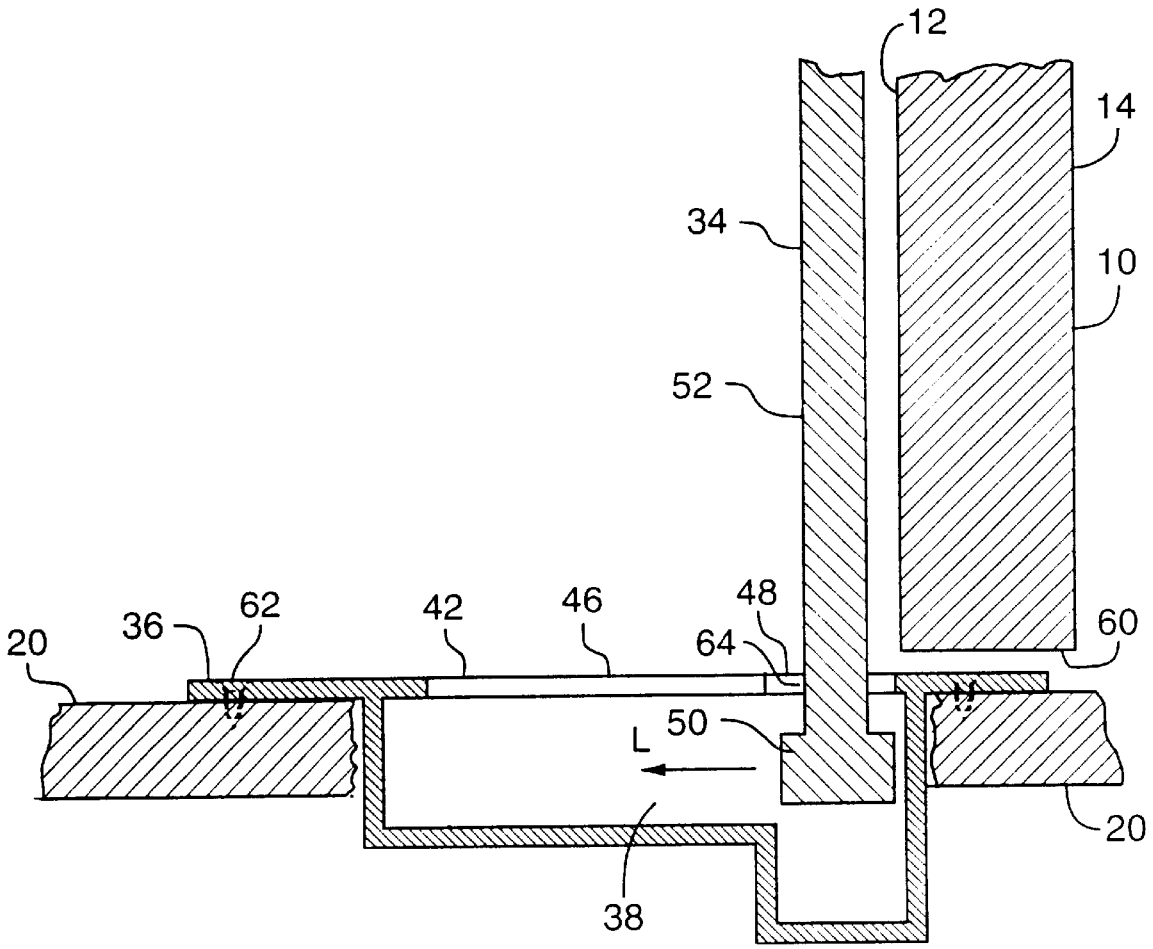
FIG. 8 is a cross-sectional view along line 8—8' of FIG. 6.

As shown in FIG. 8, when bolt 34 is in the first engaged position, it is movable in a lengthwise dimension of the central opening 42 of floor plate 36, the lengthwise dimension being represented by arrow L in FIG. 8. This movement permits door 10 to be opened by a predetermined amount A (shown in FIG. 9), while maintaining bolt 34 in the first engaged position to provide protection against forced entry.

The length of central opening 42 in floor plate 36 is preferably sufficient such that, when bolt 34 is in its first engaged position, the door 10 may be partially opened but intruders are prevented from gaining entry. Preferably, the door 10 may be opened by an amount of from about 1 to about 10 inches, more preferably from about 2 to about 6 inches, and most preferably about 2 to 3 inches. Therefore, the length of central opening is preferably from about 2 to about 13 inches, and most preferably about 4 to about 5 inches, allowing for the thickness of the door.

The means by which the bolt 34 may be locked into, or released from, its first engaged position will now be described below.

Figure 10:
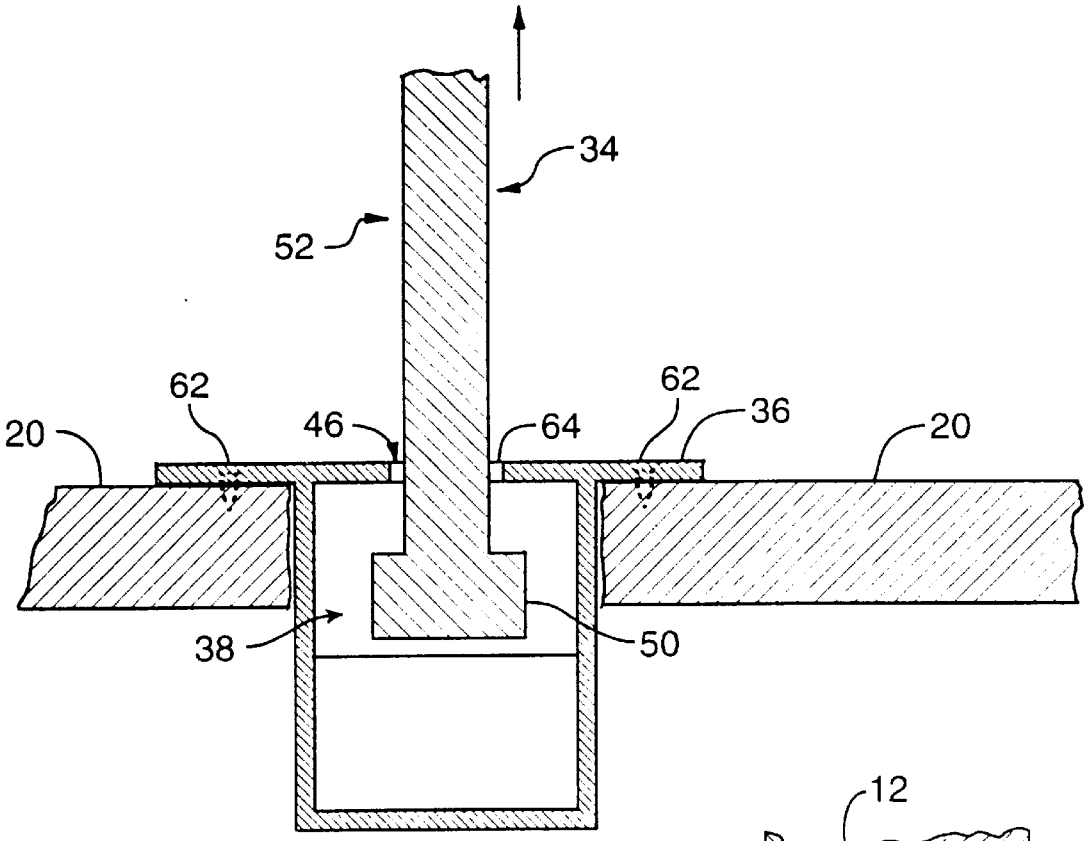
FIG. 10 is a cross-sectional view along line 10—10' of FIG. 9.

Referring to FIG. 10, when the bolt 34 is engaged with the elongate slot portion 46 of opening 42, it is locked in place and cannot be withdrawn since end portion 50 of bolt 34 has a diameter greater than the width W1 of elongate slot portion 46 of opening 42 in floor plate 36.

Figure 7:
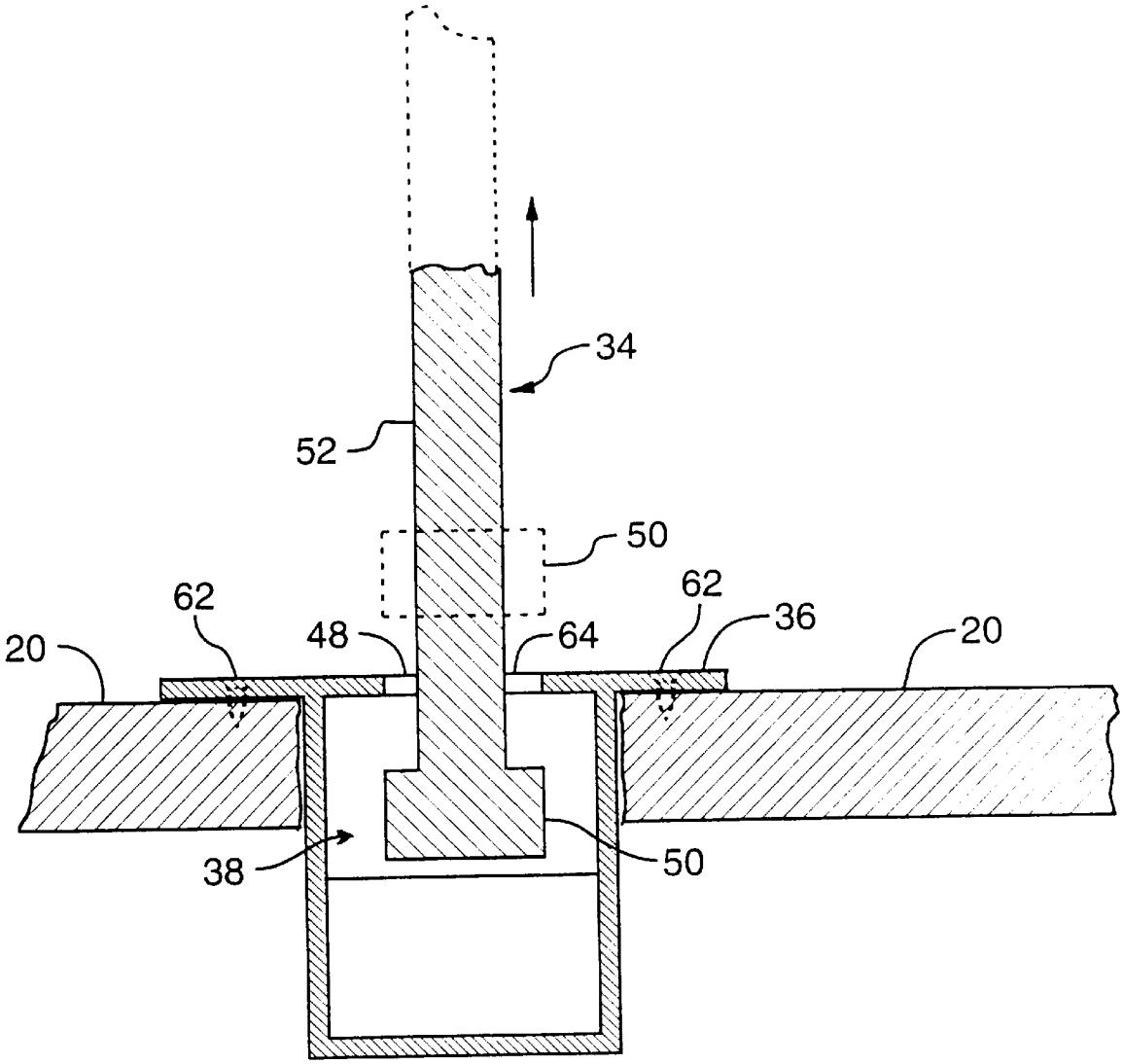
FIG. 7 is a cross-sectional view along line 7—7' of FIG. 6.

On the other hand, FIGS. 7 and 8 show bolt 34 in engagement with the enlarged portion 48 of opening 42 in floor plate 36. In this position, it is possible to withdraw or insert bolt 34 into aperture 38 through floor plate 36, since the width W3 of the enlarged portion 48 of opening 42 is larger than the diameter of end portion 50 of bolt 34. FIG. 7 shows in dotted lines the position of bolt 34 after it is completely disengaged from aperture 38. When bolt 34 is disengaged, the door 10 may be opened completely.

As shown throughout the drawings, the floor plate 36 is preferably positioned with the enlarged portion 48 of opening 42 closest to the door opening 18, so that when the door 10 is completely closed, bolt 34 may be engaged only with the enlarged portion 48 of opening 42. This preferred positioning of plate 36 permits bolt 34 to be disengaged from, or brought into engagement with, aperture 38 only when the door 10 is completely closed. Conversely, since bolt 34 is engaged with slot 46 only when the door 10 is partially open, bolt 34 cannot be withdrawn from its first engaged position with the door 10 open.

In addition to the first engaged position of bolt 34 described above, it is preferred that bolt 34 be able to adopt a second engaged position in which the security lock also functions in a manner similar to a conventional deadbolt lock. The second engaged position of bolt 34 is best illustrated in FIG. 11.

Figure 11:
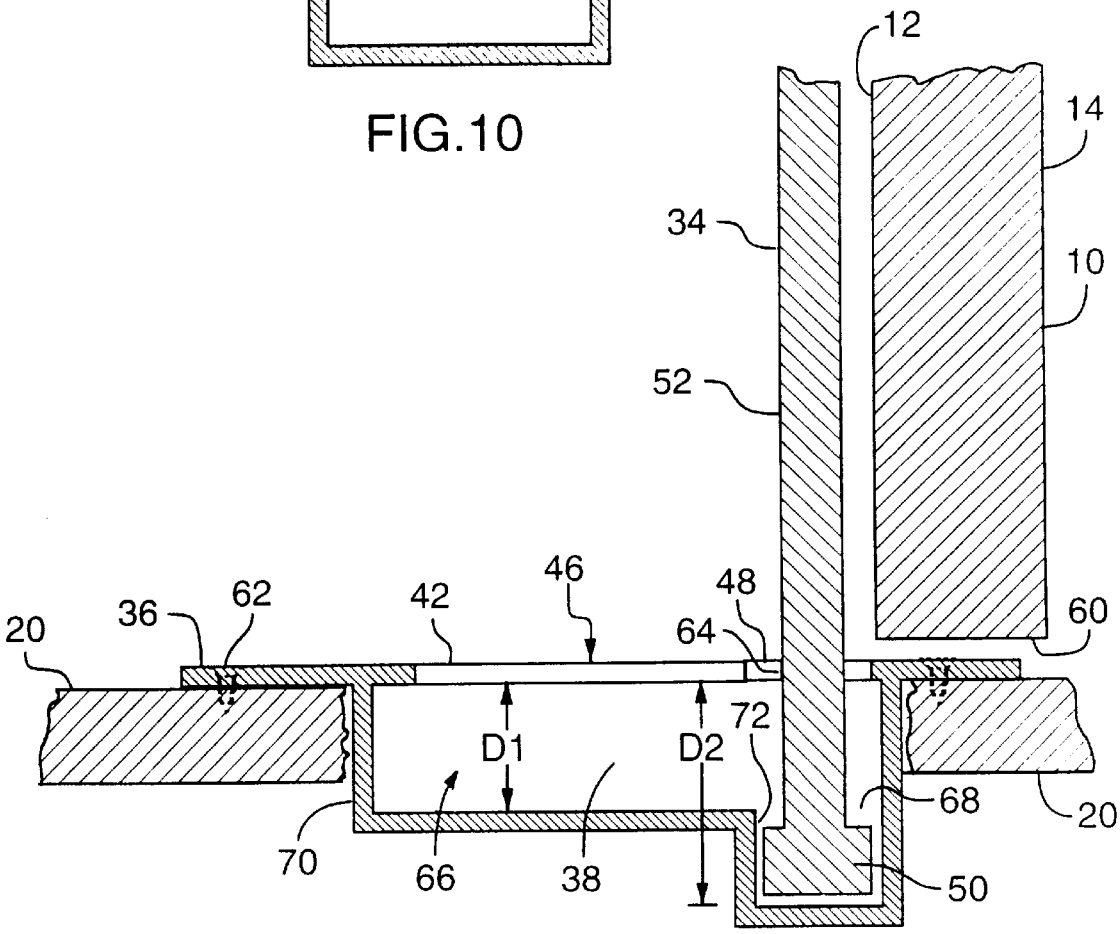
FIG. 11 is a cross-sectional view along line 8—8' of FIG. 6 showing the bolt in the second engaged position.

In order for bolt 34 to adopt the second engaged position as shown in FIG. 11, it is preferred that aperture 38 has two portions of different depths. For example, aperture 38 in FIG. 11 has a first portion 66, underlying the elongate slot 46, having a depth D1, as well as a second portion 68, underlying the enlarged portion 48 of opening 42, having a depth D2. As shown in FIG. 11, D2 is greater than D1. D1 is preferably about ½ inch and D2 is preferably about 1.5 inches.

As illustrated in FIGS. 7, 8, 10 and 11, it is particularly preferred that the aperture 38 is defined by a metal box-like structure 70 which is attached at its upper periphery to floor plate 36, for example by welding. One end of box structure 70 is formed into a pocket 72 which defines the second, deeper portion 68 of aperture 38.

Although the preferred embodiment of the invention utilizes a floor plate 36 combined with box structure 70, it is to be appreciated that aperture 38 may be formed directly in floor 20, with floor plate 36 being fastened directly over aperture 38.

Figure 9:
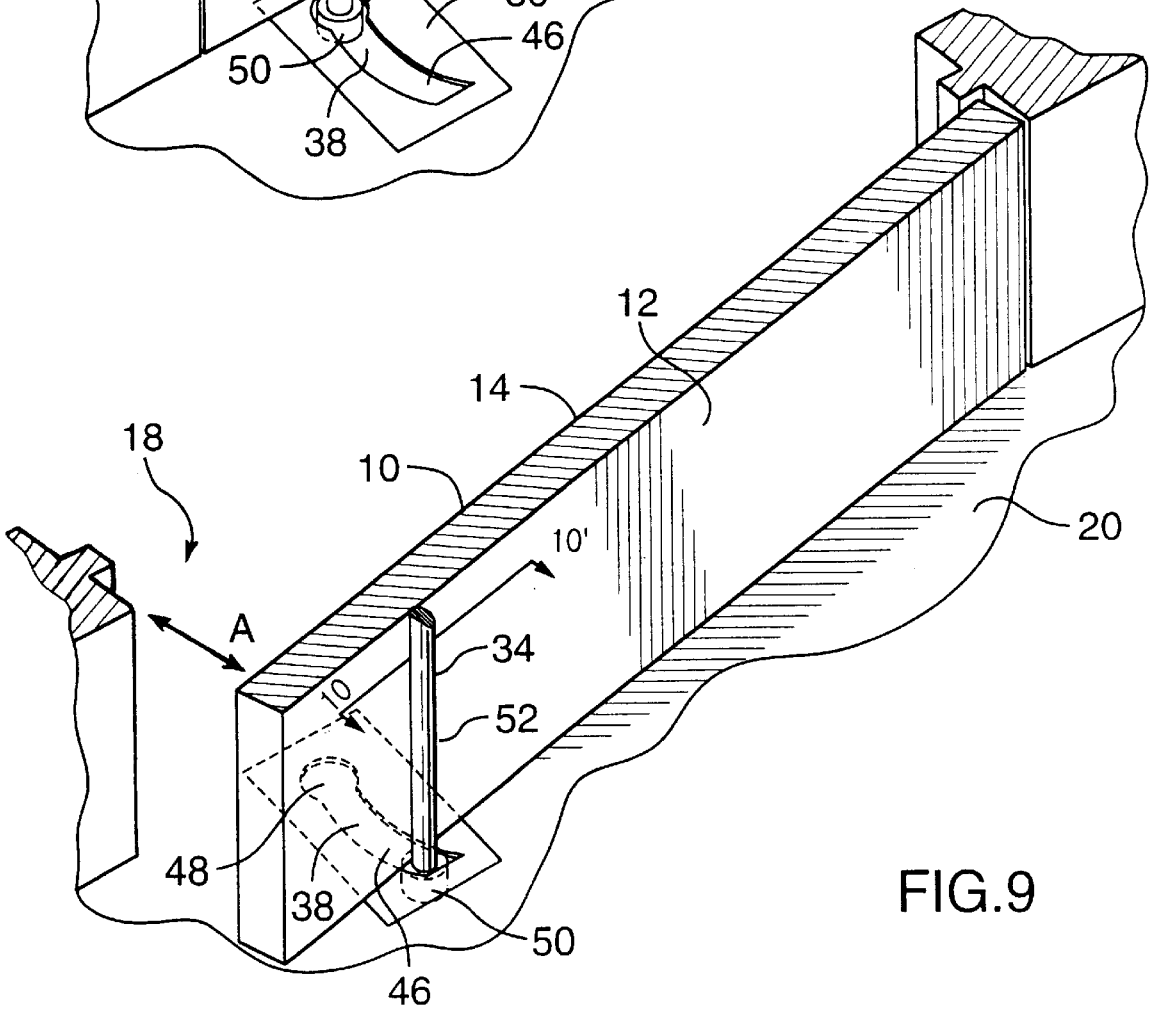
FIG. 9 is a cut-away perspective view showing the bottom portion of the door and the security of FIG. 1, with the door partially open.

When end portion 50 of bolt 34 extends to less than or equal to depth D1, it is in the first engaged position, and door 10 may be opened by distance A as in FIG. 9. In contrast, when end portion 50 of bolt extends to a depth greater than D1, it is received in the pocket formed by the second portion 68 of aperture 38, and is therefore in the second engaged position. In the second engaged position, opening of door 10 is prevented.

The following is a detailed description, in conjunction with FIGS. 12 to 17, of preferred mechanisms for engaging and disengaging bolt 34 of preferred security lock 28.

Figure 12:
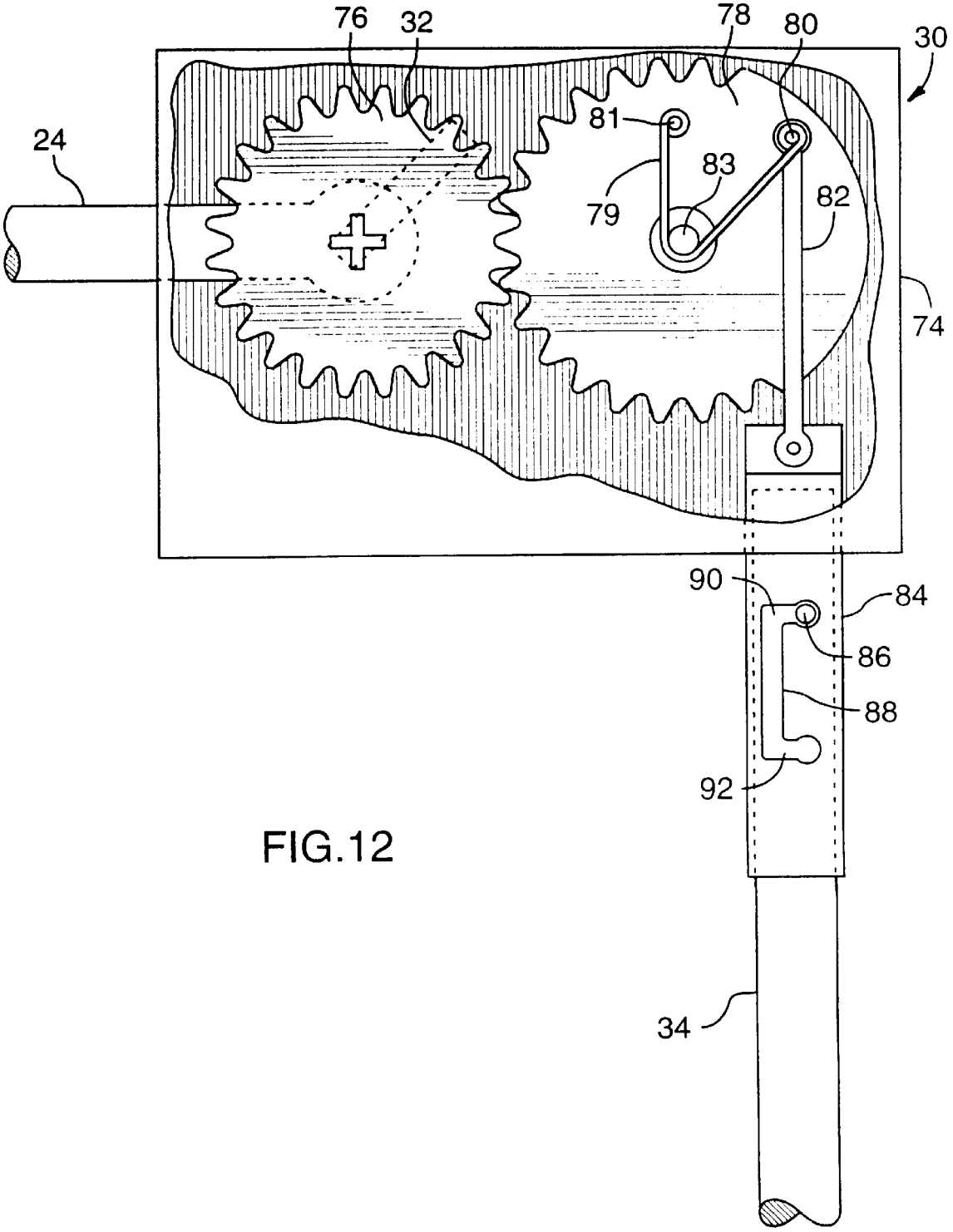
FIG. 12 is a cut-away isolated view of the first preferred locking mechanism shown in FIG. 1;.

FIG. 12 illustrates preferred lock mechanism 30 in isolation from the door 10 on which it is installed, and having its front cover cut away to reveal its internal parts. Lock mechanism 30 provides a means by which both the horizontal deadbolt 24 and vertical bolt 34 may be simultaneously engaged and disengaged. As shown in FIG. 12, lock mechanism 30 comprises lock box 74 enclosing two gears, a first gear 76 connected to horizontal deadbolt 24, and a second gear 78 connected to vertical bolt 34 of security lock 28.

Hand-operated latch 32, shown in FIG. 12 in dotted lines, turns first gear 76 and also extends and retracts deadbolt 24 in a conventional manner. It is to be appreciated that hand-operated latch 32 may preferably be replaced by a key-operated latch (not shown), and that the outer face 14 of door 10 is preferably provided with a key-operated latch mechanism (not shown) which turns gear 76.

As shown in FIG. 12, first and second gears 76 and 78 mesh with one another such that rotation of first gear 76 rotates second gear 78 in the opposite direction. This permits horizontal deadbolt 24 and vertical bolt 34 to be operated simultaneously by turning first gear 76.

Vertical bolt 34 is connected to second gear 78 via V-shaped spring mechanism 79 and connecting rod 82. One end of spring 79 is attached to the front cover (not shown) of lock box 74 by a rivet 81, and the other end of spring 79 is connected to the upper end of connecting rod 82 and to second gear 78 by a rivet 80. Spring 79 is preferably a torsion spring and is flexed at the shaft 83 on which second gear 78 rotates. Counter-clockwise rotation of first gear 76 results in clockwise rotation of second gear 78, causing downward movement of connecting rod 82. Since one end of spring 79 is fixed to lock box 74 and the other end is moving with gear 78, spring 79 is caused to open, resulting in upward biasing of the connecting rod 82.

With horizontal deadbolt 24 engaged (in the locked position) as shown in FIG. 1, vertical bolt 34 may either be in the first or second engaged position, thereby providing a second lock to prevent forced entry through door 10. When horizontal deadbolt 24 is disengaged (unlocked), vertical bolt 34 may either be in the first engaged position as shown in FIG. 8 or the disengaged position shown in dotted lines in FIG. 7. Therefore, with horizontal deadbolt 24 unlocked, door 10 may either be opened partially, with bolt 34 in the first engaged position, or door 10 may be opened completely with bolt 34 completely disengaged.

Therefore, vertical bolt 34 is capable of adopting two positions for each position of the horizontal deadbolt 24, and security lock 28 is preferably provided with a separate mechanism by which the desired position of bolt 34 may be selected. As shown in FIG. 12, the lower end of connecting rod 82 is attached to vertical bolt 34 via a hollow sleeve 84 which, together with the upper end of bolt 34, acts as a hand-operated mechanism to raise and lower bolt 34.

Figure 13:
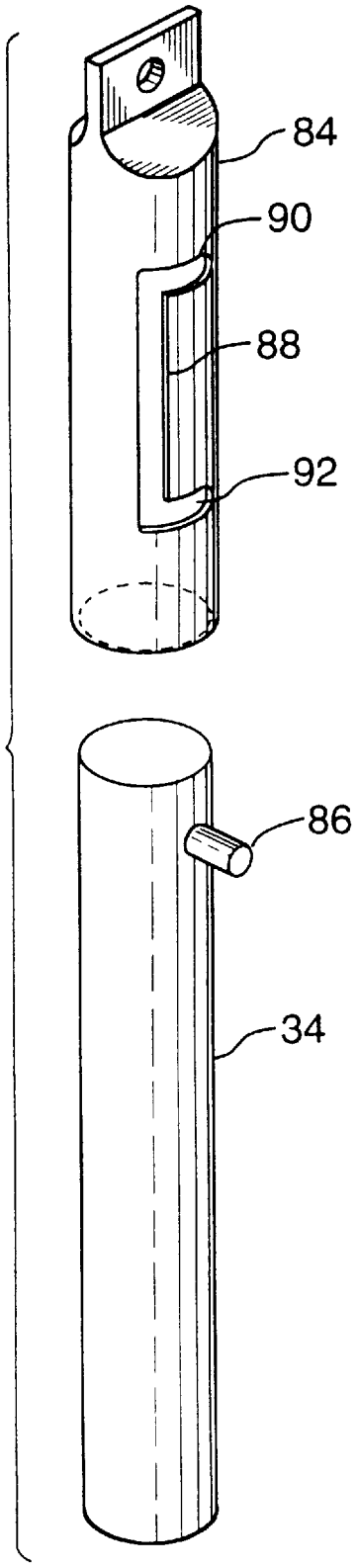
FIG. 13 is an exploded, perspective view showing in isolation the upper end of the vertical bolt and the hollow sleeve of the first preferred locking mechanism of the present invention.
Figure 14:
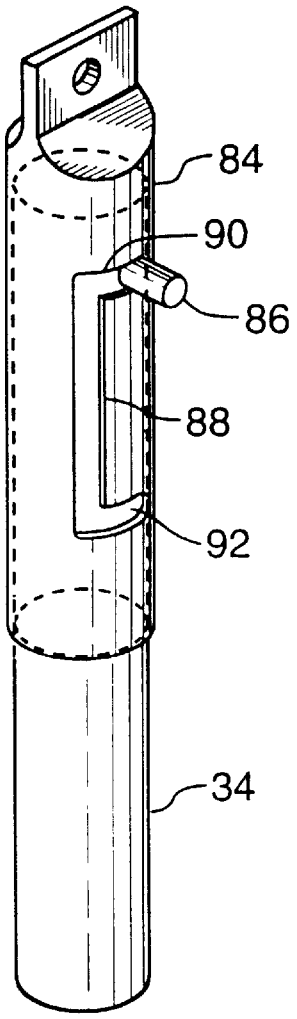
FIG. 14 is a perspective view showing the components of FIG. 13 in a first assembled state.
Figure 15:
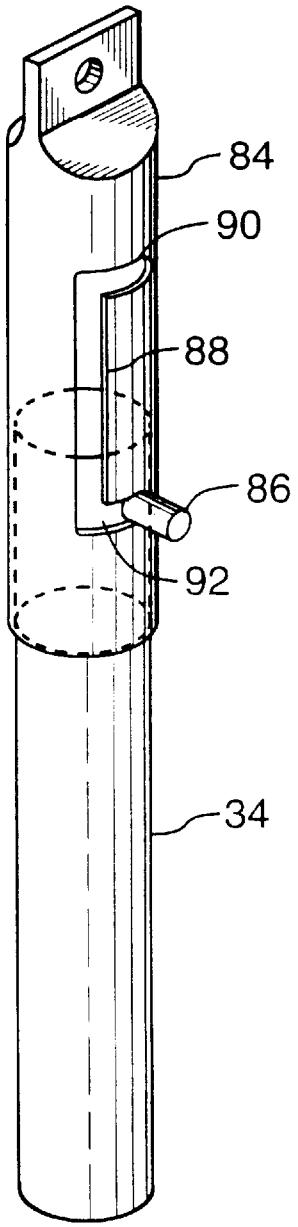
FIG. 15 is a perspective view showing the components of FIG. 13 in a second assembled state.

FIGS. 13 to 15 provide isolated views of hollow sleeve 84 and the upper end of bolt 34 which, as shown in FIG. 12, is received and retained within sleeve 84. In the exploded view of FIG. 13, the upper end of bolt 34 is shown as being provided with an outwardly projecting knob 86 which may preferably be threaded into or otherwise attached to bolt 34 after the upper end of bolt 34 is inserted into hollow sleeve 84.

As shown in FIGS. 12 to 15, a C-shaped opening 88 is formed in sleeve 84. The knob 86 on bolt 34 projects through this opening 88 when the upper end of bolt 34 is received inside hollow sleeve 84, thereby preventing removal of bolt 34 from sleeve 84.

When knob 86 on bolt 34 is received in the upper arm 90 of C-shaped opening 88, as shown in FIGS. 12 and 14, the lower end of bolt 34 has two possible positions, either disengaged or in the first engaged position shown in FIG. 8, depending on the position of horizontal deadbolt 24. Preferably, knob 86 would be received in upper arm 90 of opening 88 when it is desired to de-activate the door stop feature of security lock 28, so that when horizontal deadbolt 24 is unlocked, door 10 may be completely opened.

When knob 86 is moved through opening 88 to become received in lower arm 92, as shown in FIG. 15, bolt 34 is in either the first or second engaged position, depending on the position of horizontal deadbolt 24. Preferably, knob 86 is received in lower arm 92 of opening 88 when it is desired to use the door stop feature of security lock 28. Specifically, with horizontal deadbolt 24 locked, vertical bolt 34 is in the second engaged position shown in FIG. 11. With horizontal deadbolt 24 unlocked, vertical bolt 34 is in the first engaged position shown in FIG. 8, so that door 10 may be partially opened as shown in FIG. 9.

Figure 16:
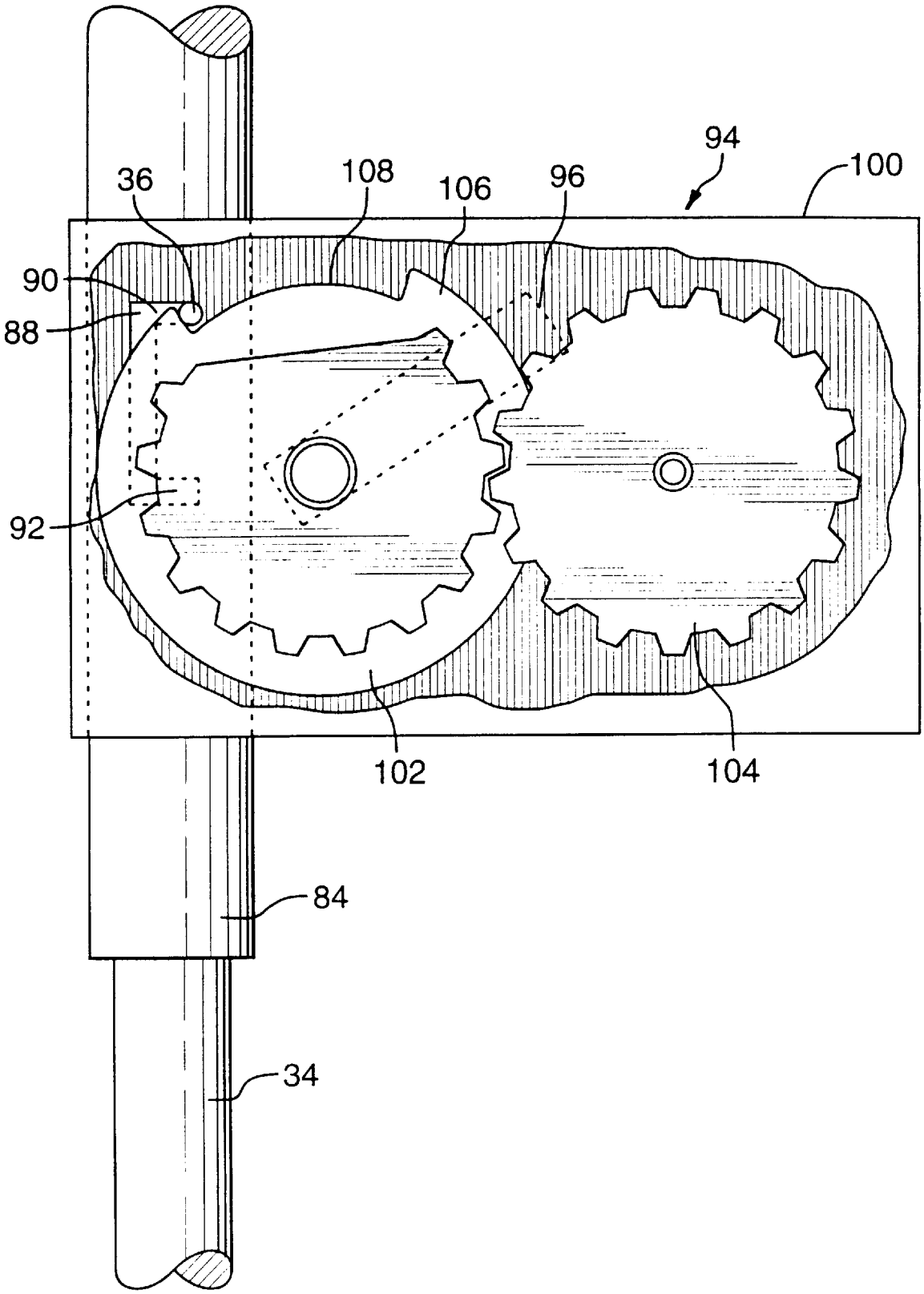
Figure 17:
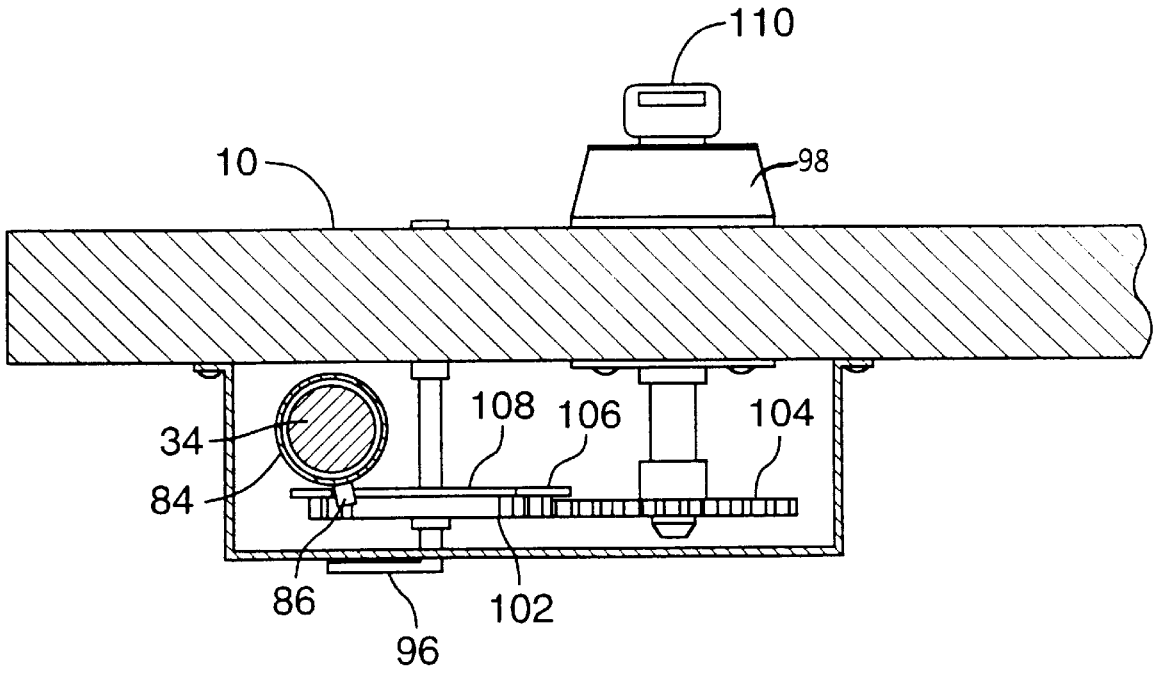
FIG. 17 is a cross-sectional, top plan view of the second preferred locking mechanism of FIG. 16 applied to the door of FIG. 1.

In another preferred aspect of the present invention, shown in FIGS. 16 and 17, a second lock mechanism 94 is provided so that bolt 34 may be raised and lowered from inside the door 10 by a manual latch 96 or a key-operated latch (not shown), or from outside the door by a key operated latch 98. Second lock mechanism 94 is separately mounted on door 10 below first lock mechanism 30, and includes a lock box 100 which covers the upper end of bolt 34.

FIG. 16 shows second lock mechanism 94 in isolation with the front cover of lock box 100 cut away. Inside lock box 100 are two gears, a first gear 102 connected to manual latch 96 and a second gear 104 which, as best seen in FIG. 17, is connected to key operated latch 98.

First gear 102 is concentrically mounted on a circular disk 106 having a cut away portion 108. As shown in FIG. 17, knob 86 on bolt 34 engages cut away portion 108 of disk 106 such that when gear 102 is rotated, disk 106 moves knob 86 between the upper arm 90 and the lower arm 92 of C-shaped opening 88.

Furthermore, first gear 102 and second gear 104 are meshed so that turning key 110 rotates second gear 104, resulting in rotation of first gear 102 and raising or lowering of bolt 34. Therefore, the mechanism shown in FIGS. 16 and 17 provides a mechanism by which the position of bolt 34 may be changed either from inside or outside door 10. This embodiment is particularly preferred since it permits bolt 34 to be lowered to its second engaged position, shown in FIG. 11, when the occupants are not at home.

It will be appreciated that the security lock of the present invention may preferably be installed over an existing horizontal deadbolt lock mechanism. For example, the manual safety latch of the existing deadbolt lock on the inside of the door may be removed from its pin, and the lock box according to the present invention, such as lock box 30, may be installed in its place.

Although the preferred security lock 28 according to the invention may be provided at any position between the two vertical edges of the door 10, it is to be appreciated that the greatest strength is attained when the security lock 28 is located as close as possible to the edge of door 10 which is opposite the hinged edge.

Although the preferred security lock according to the present invention has been described herein as being applied to a door, it is to be appreciated that the security lock of the invention may preferably be used with other hinged structures, such as windows and gates. For example, the security lock may be provided in an inwardly opening casement window, with the bolt and lock mechanism being provided in or on the window sash and the floor plate and aperture being provided in the window sill.

Although the preferred security lock according to the invention has been described as having a vertical bolt, it is to be appreciated that a security lock may be provided where, for example, the bolt extends horizontally into a slotted opening in the side jamb of a door opening. Furthermore, a security lock may be provided in which the bolt extends upwardly into a slotted opening above the door, for example in the ceiling.

Although the preferred security lock according to the present invention has been described as being applied to a door having a conventional horizontal deadbolt, it is to be appreciated that this is not necessary. The security lock of the present invention may instead be used on its own or in combination with any other type of door lock.

Although the invention has been described in connection with certain preferred embodiments, it is not intended to be limited thereto. Rather, it is intended that the invention cover all alternate embodiments as may be within the scope of the following claims. The invention also includes all embodiments which are functional equivalents of the specific embodiments and features which have been described herein.

It will be further understood that, although various features of the invention have been described with respect to one or another of the embodiments of the invention, the various features and embodiments of the invention may be combined or used in conjunction with other features and embodiments of the invention as described herein.

What is claimed is:

1. In combination, a door pivotally mounted in a door opening above a horizontal floor, the door mounted in the door opening for pivoting about a vertical axis between open and closed positions in the door opening, the door having an outer face and an opposed inner face, the door further having a lower edge proximate the floor, an elongate aperture in the floor adjacent to the door, a security lock comprising:

(a) elongate bolt secured to said door so as to be slidably mounted parallel to one of said faces, said bolt being extendable into a first engaged position wherein an end portion of the bolt extends outwardly of the lower edge of said door and into the elongate aperture in the floor; the bolt being substantially vertical relative the floor, (b) locking means preventing withdrawal of said bolt from said aperture while said door is in an open position; and (c) releasing means allowing said bolt to be inserted into, and withdrawn from, said aperture while said door is in a closed position, wherein said bolt is movable in a lengthwise dimension of said elongate aperture by pivoting movement of said door, thereby permitting said door to be opened by a predetermined amount with said bolt in said first engaged position;

the bolt extends outwardly of said inner face of the door and is secured to the inner face of the door by at least one bracket permitting longitudinal sliding of the bolt therethrough;

said locking means comprises:

i. a plate covering said aperture and having an elongate opening, a width of the elongate opening being less than a width of the aperture;

ii. said end portion of said bolt having a diameter greater than the width of the elongate opening in the plate, wherein said end portion is received in said elongate aperture when said bolt is in said first engaged position; and iii. an intermediate portion of the bolt adjacent said end portion having a diameter less than the width of the elongate opening in the plate, at least a portion of said intermediate portion of the bolt being in registry with the elongate opening of the plate when the bolt is in said first engaged position, said releasing means comprises an enlarged opening in the plate having a width greater than the width of the elongate opening and greater than the diameter of the end portion of the bolt, said enlarged opening communicating with the elongate opening of the plate and being positioned so that when said door is closed, the end portion of the bolt may be withdrawn from and inserted into said aperture through said enlarged opening in said plate, and wherein:

a first portion of the aperture, into which the bolt is extendable through the elongate opening in the plate, has a first depth;

a second portion of the aperture into which the bolt is extendable through the enlarge opening in the plate, has a second depth;

the second depth is greater than the first depth;

in the first engaged position, the bolt extends into said aperture to a first engaged depth less than or equal to the first depth of the aperture; and in a second engaged position, the bolt extends into said second portion of the aperture to a second engaged depth greater than the first depth of the aperture, such that, when the bolt is in said first engaged position, the door is openable by a predetermined amount, and when said bolt is in said second engaged position, the door is closed.

2. The combination according to claim 1, wherein said enlarged opening communicates with an end of the elongate opening closest to the door opening.

3. The combination of claim 1, wherein said door has a first vertical edge connected by a hinge to an edge of the door opening, and a second vertical edge remote from said first vertical edge.

4. The combination of claim 3, wherein said aperture in said floor is proximate said second vertical edge of said door.

5. The combination of claim 3, wherein said bolt is raised from said first engaged position and lowered into said first engaged position by a first locking mechanism.

6. The combination of claim 5, wherein said first locking mechanism simultaneously controls a horizontal deadbolt extendable into an aperture in a vertical edge of said door opening.

7. The combination of claim 5, wherein said first locking mechanism is connected to an upper end of said bolt by a gear mechanism.

8. The combination of claim 1, wherein the bolt is raised from said second engaged position to said first engaged position, and lowered from said first engaged position to said second engaged position, by a locking mechanism.

* * * * *